United States Patent [19]

Janssen et al.

[11] Patent Number: 4,766,347

[45] Date of Patent: Aug. 23, 1988

[54] HIGH-PRESSURE DISCHARGE LAMP HAVING A LEAD-THROUGH WITH A PROTUBERANCE

[75] Inventors: Marc F. R. Janssen, Turnhout, Belgium; Max L. P. Renardus, Eindhoven, Netherlands

[73] Assignee: U.S. Philips Corporation, New York, N.Y.

[21] Appl. No.: 929,932

[22] Filed: Nov. 12, 1986

[30] Foreign Application Priority Data

Nov. 13, 1985 [NL] Netherlands ..... 8503117

[51] Int. Cl.[4] ..... H01J 61/073; H01J 61/36; H01J 9/28

[52] U.S. Cl. ..... 313/623; 313/625; 313/631; 445/29

[58] Field of Search ..... 313/623, 624, 625, 573, 313/631, 634; 445/29

[56] References Cited

U.S. PATENT DOCUMENTS 3,243,635 3/1966 Louden et al. ..... 313/623 X
4,560,903 12/1985 Sneijers et al. ..... 313/625

*Primary Examiner*—David K. Moore
*Assistant Examiner*—K. Wieder
*Attorney, Agent, or Firm*—Algy Tamoshunas; Brian J. Wieghaus

[57] ABSTRACT

The invention relates to a high-pressure discharge lamp comprising a discharge vessel (3) enclosing a discharge space (**3*b*) and provided with two main electrodes (4,5). Each of the main electrodes is connected to a lead-through member (40,50), which is enclosed with a clearance space (10) by a closing part (30) and is connected thereto by means of a melting glass connection (9) in a gas-tight manner. According to the invention, the lead-through member is provided with a proturberance (51) reaching as far as the closing part in such a manner that the lead-through member (50**) is passed with a clamping fit through the ceramic closure member. Thus, the lead-through member is fixed, as a result of which the manufacture of the lamp is considerably simplified.

8 Claims, 1 Drawing Sheet

HIGH-PRESSURE DISCHARGE LAMP HAVING A LEAD-THROUGH WITH A PROTUBERANCE

The invention relates to a high-pressure discharge lamp comprising a discharge vessel enclosing a discharge space and provided with a ceramic wall and with two main electrodes, between which the discharge takes place in the operating condition of the lamp. At least one of these main electrodes is connected to a lead-through member which is passed through a closing part of the discharge vessel and is enclosed with an intermediate space by the closing part. It is then connected thereto by means of a melting glass connection in a gas-tight manner. This lead-through member is provided with a protuberance reaching as far as the closing part. The term "ceramic wall" is to be understood herein to mean a wall consisting of a crystalline oxide, such as, for example, monocrystalline sapphire or polycrystalline densely sintered aluminium oxide. The closing part may constitute the wall itself of the discharge vessel. It is alternatively possible that the discharge vessel is provided with a separate closure member, which is connected, for example by sintering, or by a melting glass connection, to the wall of the discharge vessel. The filling of the discharge vessel may contain besides one or more metals also one or more rare gases and one or more halides. The filling may further be partly present in excess quantity.

European Patent Application No. 0 087 830 A1, corresponding to U.S. Pat. No. 4,560,903, discloses a lamp of the kind mentioned in the opening paragraph which is known as an efficient light source. In the known lamp, the protuberance extends throughout the circumference of the lead-through member, as a result of which a limitation of the melting glass connection is formed, and it is achieved that melting glass is screened from the filling of the discharge vessel.

The properties of a lamp are determined to a considerable extent by the relative position of each of the main electrodes. The latter is determined by the extent to which the lead-through member is passed through the closure member. Therefore, it is necessary that the position of the lead-through member in the closure member is fixed during the step of providing the melting glass connection. For this purpose, it is known in the art to provide the lead-through member with a stop which abuts against the closure member and to fix the lead-through member in the abutment position by means of an externally exerted force, for example by means of a weight. After the melting glass connection has been provided, the externally exerted force, for example the weight, should be removed. This results in a comparatively laborious method of manufacturing. A further aspect of the usual manufacture is that the position of the lead-through member by application of the external force is generally found to vary due to deformation to which the stop is then subjected. The accuracy of the main electrode position is thus adversely affected.

The invention has for its object to provide a means by which a lamp of the kind mentioned in the opening paragraph can be manufactured in a simpler and more accurate manner. For this purpose, the lamp according to the invention is characterized in that the lead-through member is passed through the ceramic closing part with a clamping fit due to the protuberance.

An advantage of the invention is that during the manufacture of the lamp the lead-through member need not be fixed by means of a temporarily externally exerted force. A further advantage is that the lead-through member need not be provided itself with an abutment stop. The invention can be used in a construction for limiting the melting glass connection, but it is not limited thereto. Thus, a melting glass limitation construction may be formed separately. The invention can also be used in a lamp vessel construction in which a melting glass limitation construction is not desired.

In a preferred embodiment, the lead-through member is pin-shaped and the protuberance of the pin-shaped lead-through is obtained by bending. A pin can be bent with comparatively small effort. Moreover, when a pin-shaped lead-through member thus formed is provided in a ceramic part, the risk of a defect is small. This embodiment is now understood in contrast with the known lamp art, for example, in which the protuberance is formed by the scraping of the pin-shaped part. The scraped protuberance will in fact break off under the influence of the friction with the ceramic part, as a result of which the clamping fit is lost entirely or in part.

In a further preferred embodiment, the pin-shaped lead-through member is provided with two protuberances obtained by bending and located on either side of the longitudinal axis of the lead-through member. The protuberances together with a third point of the lead-through member ensure that a three-point clamping fit of the lead-through member is obtained. Thus, the clamping fit substantially does not influence the extent of the melting glass connection provided so that it does not adversely affect the gas-tightness of the melting glass connection.

Although, in the case of the lead-through member comprising a thin-walled tube portion which is passed with clamping fit through the ceramic closing part, all kinds of geometric forms of protuberances can be used, the outer surface of the tube portion is preferably provided with several mutually separated protuberances which are distributed along the periphery of the tube portion. The protuberances may then be located in a common plane at right angles to the longitudinal axis of the tube portion. However, when viewed along the longitudinal axis, they may alternatively be distributed along the outer surface. Thus, it has proved possible to provide a clamping fit sufficient for fixing the lead-through member with only local interruption of the gas-tight melting glass connection between the closing part and the lead-through member.

Two protuberances arranged diametrically opposite to each other have proved to be sufficient. By a suitable choice of distribution along the periphery, three protuberances provide an effective centering of the lead-through member in the closing part.

Preferably, the protuberances of the tube portion are obtained by means of a plastic non-removing metal deformation of the thin-walled tube portion, as a result of which the clamping fit cannot be lost by the fact that one or more protuberances break off. Moreover, the possibility of occurrence of a perforation of the wall of the tube portion is a minimum with such an operation. A tube which is perforated having the deforming step generally cannot be used.

A lamp according to the invention will now be described with reference to a drawing, in which.

Figure 1:
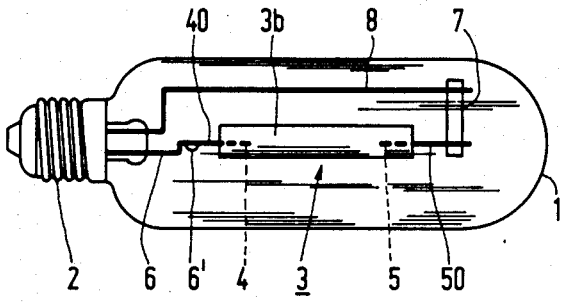
FIG. 1 shows a lamp.

FIG. 1 shows a lamp comprising an outer envelope 1 and a lamp cap 2. Inside the outer envelope 1 there is arranged a discharge vessel 3 enclosing a discharge space 3*b* (FIG. 2) and provided with two main electrodes 4 and 5. The main electrode 4 is connected to a lead-through member 40, which is electrically connected through a flexible conductor 6' to a rigid current conductor 6. The main electrode 5 is connected to the lead-through member 50, which is electrically connected through an auxiliary conductor 7 to the rigid current conductor 8.

Figure 2:
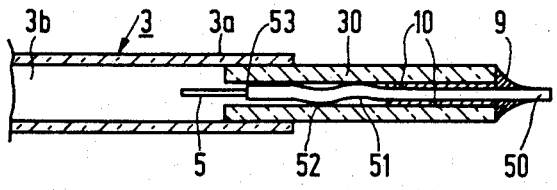
FIG. 2 shows of a first embodiment of the discharge vessel of the lamp shown in FIG. 1 in a partial section view.

As shown in the section view in FIG. 2 the discharge vessel 3 has a cylindrical ceramic wall 3*a*. The main electrode 5 is connected to the pin-shaped lead-through member 50. The lead-through member 50 is passed through the closing part 30 and is enclosed with an intermediate space 10 by the closing part 30. The closing part 30 consists of a separate ceramic closure member extending in part outside the cylindrical part 3*a* of the discharge vessel 3. The lead-through member 50 is provided with protuberances 51 and 52, each reaching as far as the closing part 30. An end 53 of the pin-shaped lead-through member 50 bears on the closure member 30 and together with the protuberances 51 and 52 ensures that the lead-through member 50 is passed with a three-point clamping fit through the closure member 30. The lead-through member 50 is connected in a gas-tight manner to the closing part 30 by means of a melting glass connection 9 extending in the intermediate space 10.

In a preferred embodiment of the discharge vessel shown in FIG. 2, the wall 3*a* of the discharge vessel 3, like the closure member 30, consists of polycrystalline densely sintered aluminium oxide. The wall 3*a* and the closure member 30 are joined together by means of sintering in a gas-tight manner. The electrodes 4 and 5 consist of tungsten pins having a cross-section of 300 μm and a length of 3 mm. The distance between the electrodes is 13 mm. The lead-through members are niobium pins having a cross-section of 0.72 mm, and the closure members each have an inner diameter of 0.76 mm. The cylindrical part of the discharge vessel 3 has an inner diameter of 2.5 mm. The filling of the discharge vessel contains 10 mg of mercury sodium amalgam comprising 73% by weight of mercury and xenon at a pressure at 300K of 53 kPa. The use of such a discharge vessel in an outer envelope yields a lamp which, when connected in series with a stabilization ballast of about 1.4H and operated at a supply voltage of 220 V, 50 Hz, consumes about 30 watts of power.

Figure 3:
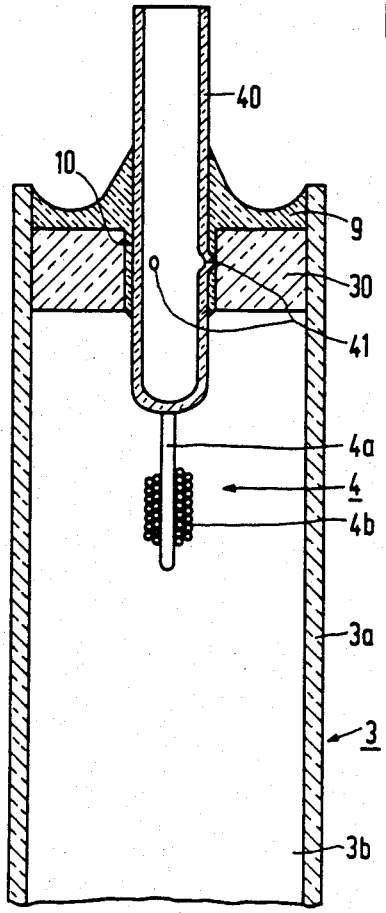
FIG. 3 shows of a second embodiment of the discharge vessel of the lamp shown in FIG. 1 in a partial section view.

As shown in the sectional view in FIG. 3, the part of the discharge vessel 3 with the ceramic wall 3*a* has a main electrode consisting of electrode windings 4*b* on an electrode rod 4*a* which is connected to the lead-through member 40. The lead-through member 40 is passed through the closing part 30 and is enclosed with an intermediate space 10 by the closing part 30. The closing part 30 consists of a separate ceramic closure member, which is secured by means of sintering to the wall 3*a* of the discharge vessel 3. The lead-through member 40 is provided with three substantially spherical protuberances 41 which are located in one plane, which each reach as far as the closing part 30 and which are uniformly distributed along the periphery of this lead-through member 40. The lead-through member 40 is connected in a gas-tight manner to the closing part 30 by means of the melting glass connection 9. The melting glass connection 9 extends in the intermediate space 10. The lead-through member 40 is constructed as a thin-walled tube portion of niobium or molybdenum, which at the area of the spherical protuberances 41 is plastically deformed by a non-removing metal operation.

In a practical embodiment, the thin-walled tube portion of niobium has an outer diameter of 2 mm and an inner diameter of 1.68 mm.

Each of the protuberances has a larger radial dimension with respect to the outer surface of 0.07 mm and a center line measured along the periphery of the tube 0.5 mm. The ceramic closing part 30 consists of polycrystalline densely sintered aluminium oxide and has an inner diameter of 2.06 mm.

What is claimed is:

1. A high pressure discharge lamp, comprising:

(a) an outer envelope;

(b) an elongate discharge vessel having a pair of closing members each at a respective end of said discharge vessel, each said closing member having a surface defining a bore through said each closing member, a longitudinal axis of said bore aligned with the longitudinal axis of said discharge device;

(c) a solid cylindrical lead-through member extending through said bore into said discharge vessel defining an intermediate space between said bore surface and said cylindrical lead-through, said lead further comprising a curve portion defining a protrusion, said bore surface engaging said curved portion with a clamping fit whereby said lead-through is secured with respect to said bore surface and said closing member;

(d) a pair of electrodes within said discharge vessel between which a discharge takes place during lamp operation, each said electrode being connected to a respective said lead-through member; and (e) sealing means to seal said intermediate space in a gas-tight manner.

2. A lamp as claimed in claim 1, wherein said solid cylindrical lead-through member comprises two curved portions each defining a protuberance, and a straight portion, said bore surface engaging said two curved portions and said straight portion with a clamping fit whereby said lead-through is secure with respect to said bore surface and said closing portion.

3. A lamp as claimed in claim 2, wherein said lead-through member is comprised substantially of metal and said curved portions are obtained by bending said lead-through member.

4. A high pressure discharge lamp, comprising:

(a) an outer envelope;

(b) an elongate discharge vessel having a pair of closing members each at a respective end of said discharge vessel, each said closing member having a surface defining a bore through said each closure member, a longitudinal axis of said bore aligned with the longitudinal axis of said discharge device;

(c) a thin-walled tubular lead-through member having a tube wall, said lead-through extending through said bore into said discharge vessel and defining an intermediate space between said bore surface and said tubular lead-through, said tubular lead-through further comprising a plurality of protuberances of said tube wall, said bore surface engaging said protuberances with a clamping fit whereby said tubular lead-through is secured to said bore surface and said closing portion, said protuberances being substantially non-annular;

(d) a pair of electrodes within said discharge vessel between which a discharge takes place during lamp operation, each said electrode being connected to a respective said lead-through member; and (e) sealing means to seal said intermediate space in a gas-tight manner.

5. A lamp as claimed in claim 4, wherein said protuberances are formed by a plastic deformation of said tube wall.

6. A lamp as claimed in claim 4, wherein said tubular portion has three substantially spherical protuberances uniformly distributed around the periphery of said tubular portion, said protuberances lying on a plane substantially transverse to the longitudinal axis of said tubular portion so that said lead-through member is centered with said bore.

7. A lamp as claimed in claim 4, having a plurality of protuberances wherein said protuberances are spaced sufficiently apart so that the extent of said sealing means in said intermediate space is not interrupted.

8. A lamp as claimed in claim 4, having a plurality of protuberances wherein said protuberances are spaced sufficiently close so that the extent of said sealing means is interrupted by said protuberances and controlled by the position of said protuberances with respect to said closing portion.

* * * * *

UNITED STATES PATENT AND TRADEMARK OFFICE

CERTIFICATE OF CORRECTION

PATENT NO. : 4,766,347

DATED : August 23, 1988

INVENTOR(S) : JANSSEN ET AL

It is certified that error appears in the above-identified patent and that said Letters Patent is hereby corrected as shown below:

Claim 1, line 13: Insert "-through" after - - lead - -

Claim 1, line 13: Insert "curved" in place of - - curve - -

Claim 2, line 6: Insert "secured" in place of - - secure - -

Claim 2, line 7: Insert "member" in place of - - portion - -

Claim 4, line 6: Insert "closing" in place of - - closure - -

Claim 4, line 15: Insert "on" in place of --of--, second occurrence.

Claim 4, line 18: Insert "member" in place of - - portion - -

Claim 8, line 6: Insert "member" in place of - - portion - -

Signed and Sealed this

Fourteenth Day of February, 1989

*Attest:*

DONALD J. QUIGG

*Attesting Officer*

*Commissioner of Patents and Trademarks*